US006010202A

United States Patent [19]

Arnott

[11] Patent Number: 6,010,202

[45] Date of Patent: Jan. 4, 2000

[54] OPERATION OF PULSED DROPLET DEPOSITION APPARATUS

[75] Inventor: Michael George Arnott, Somersham, United Kingdom

[73] Assignee: Xaar Technology Limited, Cambridge, United Kingdom

[21] Appl. No.: 09/084,828

[22] Filed: May 26, 1998

Related U.S. Application Data

[63] Continuation of application No. PCT/GB96/02900, Nov. 22, 1996.

[30] Foreign Application Priority Data

Nov. 23, 1995 [GB] United Kingdom ..... 9523926

[51] Int. Cl.[7] ..... B41J 2/045

[52] U.S. Cl. ..... 347/10

[58] Field of Search ..... 347/10, 12, 19, 347/69, 71, 94, 68

[56] References Cited

U.S. PATENT DOCUMENTS

| | | | |
|---|---|---|---|
| 4,326,206 | 4/1982 | Raschke | 346/140 R |
| 5,266,965 | 11/1993 | Komai et al. | 346/1.1 |
| 5,557,304 | 9/1996 | Stortz | 347/15 |

FOREIGN PATENT DOCUMENTS

| | | |
|---|---|---|
| 0278590 A1 | 8/1988 | European Pat. Off. . |
| 0541129 A1 | 5/1993 | European Pat. Off. . |
| 0608835 A2 | 8/1994 | European Pat. Off. . |
| 0612623 A2 | 8/1994 | European Pat. Off. . |
| 0640480 A2 | 3/1995 | European Pat. Off. . |
| WO 92/06848 | 4/1992 | WIPO . |
| WO 94/26522 | 11/1994 | WIPO . |
| WO 95/25011 | 9/1995 | WIPO . |

*Primary Examiner*—Joan Pendegrass
*Attorney, Agent, or Firm*—Marshall, O'Toole, Gerstein, Murray & Borun

[57] ABSTRACT

An inkjet printhead comprises an array of parallel channels separated one from the next by side walls transversely displaceable in response to an actuating signal. Pattern dependent crosstalk is avoided by applying to a channel selected for actuation a signal held at a given non-zero level for a period of length greater than that the length of the period at which the velocity of droplets ejected from said channel is at its maximum and at which the velocity of a droplet ejected from said selected channel is substantially independent of whether or not channels in the vicinity of said selected channel are similarly actuated to effect droplet ejection simultaneously with droplet ejection from the selected channel.

41 Claims, 9 Drawing Sheets

T

U
(m/s)
10
9
8
7
6
5
4
3
2
1
0
1
10
100
T(μs)
A
B
$T_{des}$
T*

T
T
A
B
C
U
(m/s)
0
1
2
3
4
5
6
4
6
7
8
9
10
11
12
14
$T_{des}$
$T^*$
T(μs)

U (m/s)
14
12
10
8
6
4
2
F
G
8
10
12
14
16
18
20
T*
T(μs)
T
T
4T

OPERATION OF PULSED DROPLET DEPOSITION APPARATUS

This application is a continuation of International Application No. PCT/GB96/02900, filed Nov. 22, 1996.

The priority benefit under 35 U.S.C. §120 of International Application No. PCT/GB96/02900 filed Nov. 22, 1996 is claimed.

The present invention relates to methods of operating pulsed droplet deposition apparatus, in particular an ink jet printhead, comprising an array of parallel channels disposed side-by-side and separated one from the next by side walls extending in the lengthwise direction of the channels, a series of nozzles which communicate respectively with said channels for ejection of droplets therefrom; connection means for connecting the channels with a source of droplet fluid; and electrically actuable means for displacing a portion of a channel wall in response to an actuating signal, thereby to eject a droplet from a selected channel.

Methods of operating apparatus of the kind described above are known in the art. WO 95/25011 discloses a method of operating a multichannel pulsed droplet deposition apparatus having an array of channels disposed side by side and separated one from the next by side walls extending in the lengthwise direction of the channels. This document discusses the problem of variation in the general velocity of drops between the situation where several adjacent channels in a printhead are selected for firing and the situation where only the end channels of a printhead, or a single isolated channel in the printhead, are selected for firing. Such variation is also known as "printing pattern dependent crosstalk" since it is the firing or non-firing of neighboring channels (which in turn depends upon the pattern to be printed) that affects the velocity of the droplet ejected from any particular channel. As explained in WO 95/25011, such droplet velocity variation will result in errors in the location of the droplet on the printed page which in turn will affect the quality of the printed image. The document explains that a method of correction has been found which involves varying the length of the initial period of expansion of those channels to be fired (see FIG. 11): the period length is reduced when a higher density of channel neighbors is selected and restored to its normalised length of Lc (where L is the active length of the channel and c is the effective velocity of pressure waves in the fluid in the channel) when a single line without near neighbors is fired.

WO 94/26522 also discloses the concept of varying the length of time for which a channel is held in a contracted or expanded state, albeit for the different purpose of modulating the volume of the ejected droplet thereby to vary the size of the printed dot. FIG. 2 of this document shows the variation in drop velocity with dwell time, while page 10 explains that the largest, fastest droplet is produced at a dwell time of about 17.5 microseconds, with slower and smaller droplets being produced at dwell times shorter or longer than this optimum. However, this document makes no mention of the problem of pattern dependent crosstalk.

EP-A-O 612 623 discloses a piezoelectric droplet-dispensing device and contains some discussion of droplet velocities. It suggests that for a marketable printer the droplet velocity should be at least 1 m/s.

The present invention has as an objective a greater reduction in printing pattern dependent crosstalk than has previously been possible, thus allowing higher quality printed images.

Accordingly, the present invention consists in one aspect in a method operating a multi-channel pulsed droplet deposition apparatus having an array of parallel channels, disposed side by side and separated one from the next by side walls extending in the lengthwise direction of the channels; a series of nozzles which communicate respectively with said channels for ejection of droplets therefrom; connection means for connecting the channels with a source of droplet fluid; and electrically actuable means for displacing a portion of a side wall in response to an actuating signal, thereby to eject a droplet from said selected channel, the method comprising the steps of applying an actuating signal to said electrically actuable means to eject a droplet from a selected channel, the signal being held at a given non-zero level for a period, the length of said period being such that:

(a) it is greater than the length of that period which would result in the velocity of droplets ejected from said channel being at its maximum; and (b) the velocity of a droplet ejected from said selected channel is substantially independent of whether or not channels in the vicinity of said selected channel are similarly actuated to effect droplet ejection simultaneously with droplet ejection from said selected channel.

According to a further aspect, the present invention consists in a method of operating a multi-channel pulsed droplet deposition apparatus having an array of parallel channels, disposed side by side and separated one from the next by side walls extending in the lengthwise direction of the channels; successive channels of the array being regularly assigned to groups such that a channel belonging to any one group is bounded on either side by channels belonging to at least one other group; a series of nozzles which communicate respectively with said channels for ejection of droplets therefrom; connection means for connecting the channels with a source of droplet fluid; and electrically actuable means for displacing a portion of a side wall in response to an actuating signal, thereby to eject a droplet from a selected channel, the method comprising the steps of applying an actuating signal to said electrically actuable means to eject a droplet from a selected channel, the signal being held at a given non-zero level for a period, the length of said period being such that:

(a) it is greater than the length of that period which would result in the velocity of droplets ejected from said channel being at its maximum; and (b) the velocity of a droplet ejected from said selected channel is substantially independent of whether or not those channels belonging to the same group as the selected channel and which are located in the array directly adjacent said selected channel are similarly actuated to effect droplet ejection simultaneously with droplet ejection from the selected channel.

The invention also provides in further aspects a multi-channel pulsed droplet deposition apparatus having a drive circuit configured to apply an actuating signal having the characteristics set forth above.

In a yet further aspect the invention provides a method of selecting a signal for actuating electrically actuable means for displacing a portion of a side wall extending along a channel of a multi-channel pulsed droplet deposition apparatus, thereby to effect droplet ejection therefrom, said apparatus having an array of parallel channels, disposed side by side and separated one from the next by side walls extending in the lengthwise direction of the channels, a series of nozzles which communicate respectively with said channels for ejection of droplets therefrom and connection means for connecting the channels with a source of droplet fluid, said signal being held at a non-zero level for a period, the method comprising the steps of:

(a) applying said signal to a selected channel of said array and measuring the velocity of the droplet ejected from the selected channel;

(b) applying said signal to said selected channel and simultaneously to channels in the vicinity of said selected channel and measuring the velocity of the droplet ejected from the selected channel; and (c) choosing the length of period such that there is substantially no variation in velocity between droplets ejected from the selected channel under regime (a) and droplets ejected from the selected channel under regime (b).

In any of the various forms of the invention, the velocity of the droplet ejected from the selected channel may be greater than 1 m/s.

The aforementioned aspects result from the discovery by the originators of the present invention that, for a given printhead of the kind described above, there is a length of period at which the actuating signal can be held at a given non-zero level which is greater than that length of period at which the velocity of droplets ejected from said channel is at its maximum and at which pattern dependent crosstalk can be completely avoided. Advantageous embodiments of the invention are set out in the description and dependent claims.

The invention will now be described by way of example by reference to the following diagrams, of which:

FIG. 4(*b*) illustrates the actuating signal used in obtaining the results shown in FIG. 4(*a*);

Figure 9A:
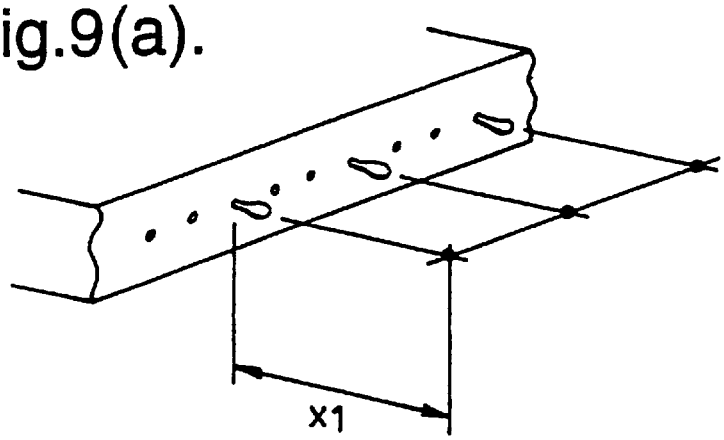
Figure 9B:
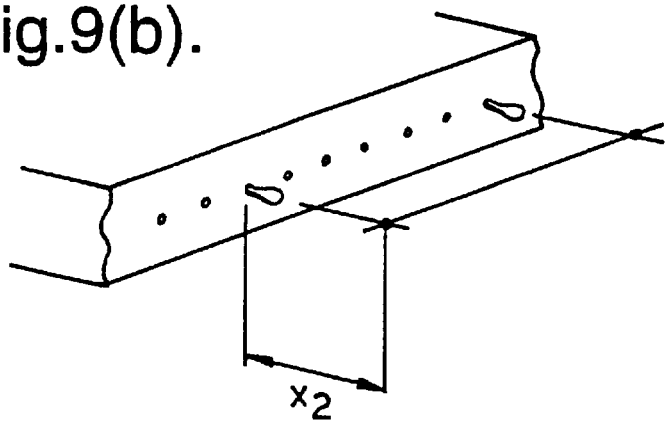
Figure 10:
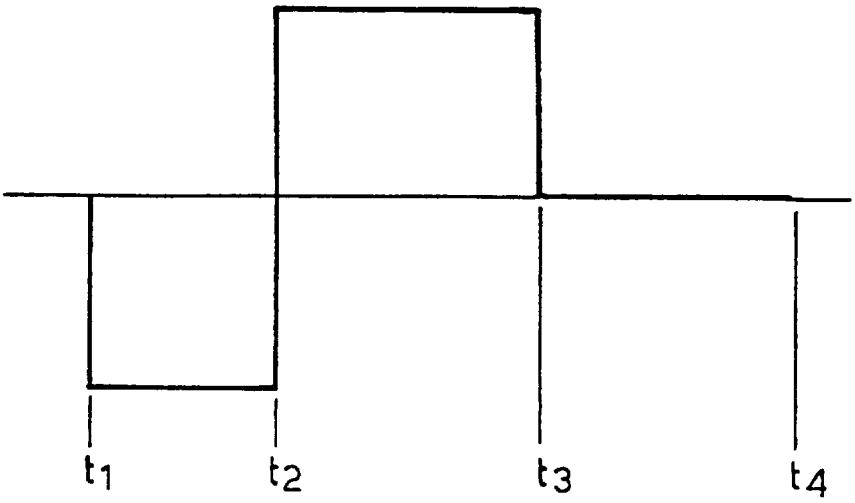

FIGS. 9(*a*) and (*b*) illustrate two possible firing patterns of a printhead operating in three cycles; and FIG. 10 illustrates a preferred embodiment of actuating signal according to the present invention.

Figure 1:
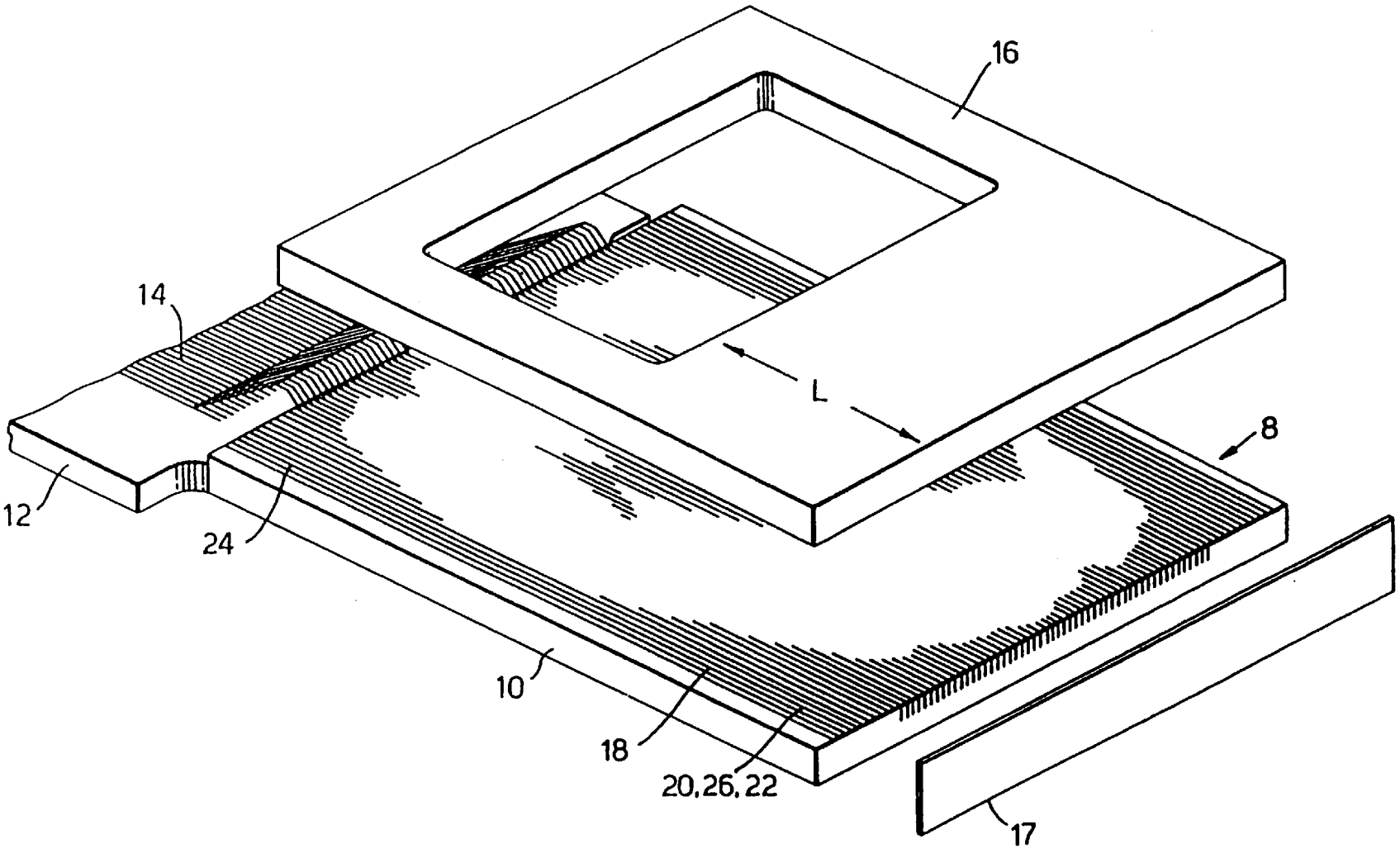
FIG. 1 illustrates an exploded view in perspective of one form of ink jet printhead incorporating piezo-electric wall actuators operating in shear mode and comprising a printhead base, a cover and a nozzle plate.

FIG. 1 shows an exploded view in perspective of a typical ink jet printhead 8 incorporating piezo-electric wall actuators operating in shear mode. It comprises a base 10 of piezo-electric material mounted on a base of 12 of which only a section showing connection tracks 14 is illustrated. A cover 16, which is bonded during assembly to the base 10 is shown above its assembled location. A nozzle plate 17 is also shown adjacent the printhead base.

A multiplicity of parallel grooves 18 are formed in the base 10 extending into the layer of piezo electric material, The grooves are formed for example as described in U.S. Pat. No. 5,016,028 and comprise a forward part in which the grooves are comparatively deep to provide ink channels 20 separated by opposing actuator walls 22. The grooves in the rearward part are comparatively shallow to provide locations for connection tracks. After forming the grooves 18, metallized plating is deposited in the forward part providing electrodes 26 on the opposing faces of the ink channels 20 where it extends approximately one half of the channel height from the tops of the walls and in the rearward part is deposited providing connection tracks 24 connected to the electrodes in each channel 20. The tops of the walls are kept free of plating metal so that the track 24 and the electrodes 26 form isolated actuating electrodes for each channel.

After the deposition of metallized plating and coating of the base 10 with a passivant layer for electrical isolation of the electrode parts from the ink, the base 10 is mounted as shown in FIG. 1 on the circuit board 12 and bonded wire connections are made connecting the connection tracks 24 on the base part 10 to the connection tracks 14 on the circuit board 12.

Figure 2:
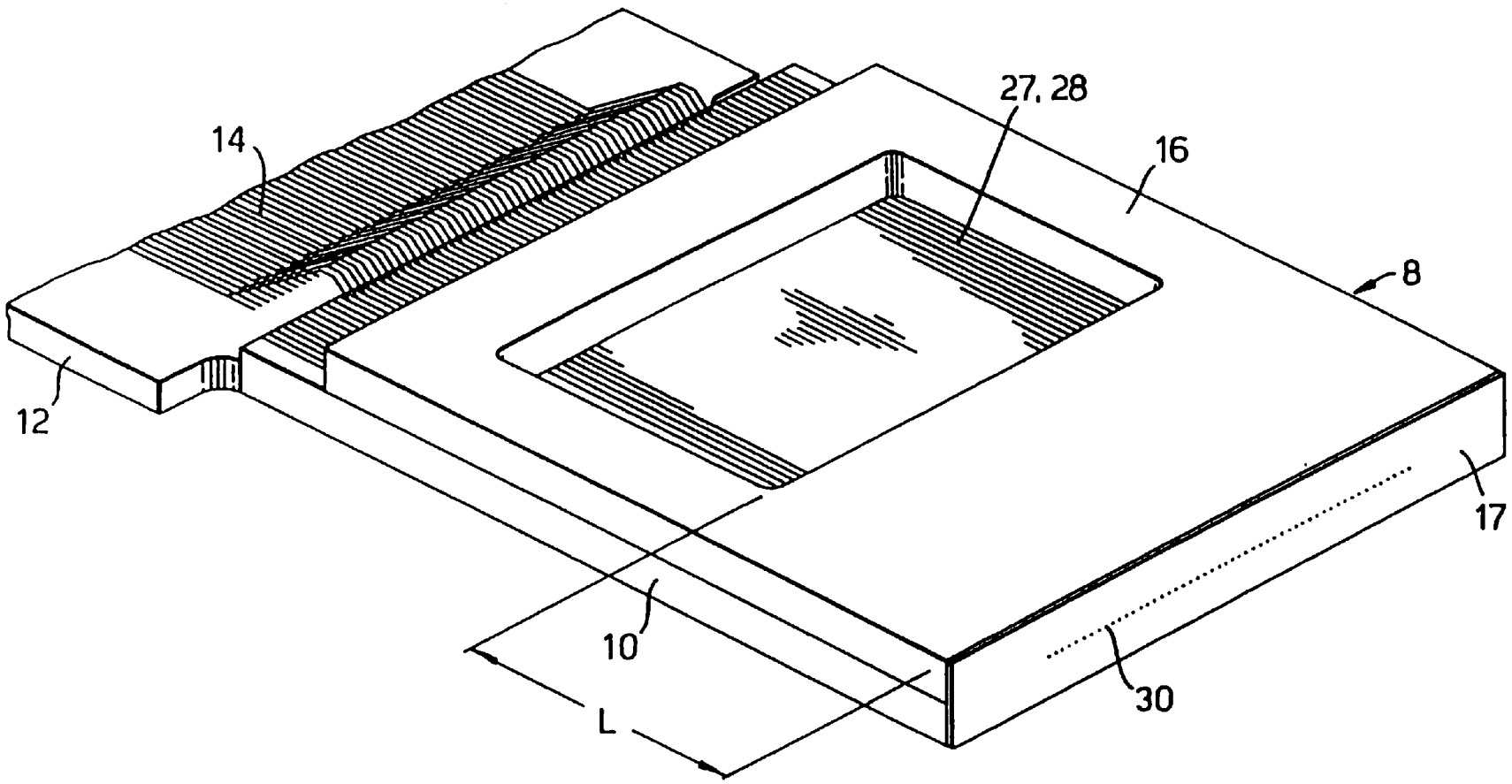
FIG. 2 illustrates the printhead of FIG. 1 in perspective after assembly.

The ink jet printhead 8 is illustrated after assembly in FIG. 2. In the assembled printhead, the cover 16 is bonded to the tops of the actuator walls 22 thereby forming a multiplicity of closed channels 20 having access at one end to the window 27 in the cover 16 which provides a manifold 28 for the supply of replenishment ink. The nozzle plate 17 is attached by bonding at the other end of the ink channels. The nozzles 30 are shown in locations in the nozzle plate communicating to each channel formed by UV excimer laser ablation.

Figure 3:
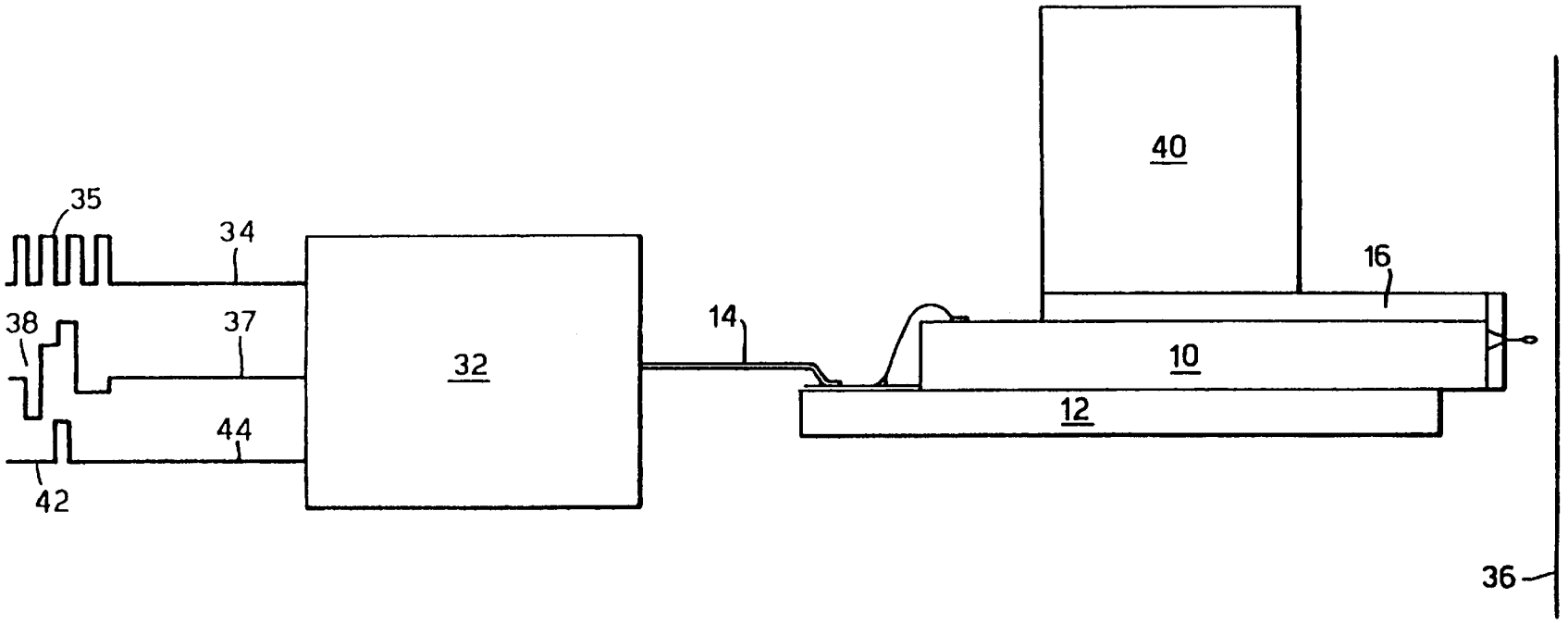
FIG. 3 illustrates a drive circuit connected via connection tracks to the printhead and to which is applied an actuating signal, timing signals and print data for the selection of ink channels.

The printhead is operated by delivering ink from an ink cartridge via the ink manifold 28, from where it is drawn into the ink channels to the nozzles 30. The drive circuit 32 connected to the printhead is illustrated in FIG. 3. In one form it is an external circuit connected to the connection tracks 14, but in an alternative embodiment (not shown) an integrated circuit chip may be mounted on the printhead. The drive circuit 32 is operated by applying-(via a data link 34) print data 35 defining print locations in each print line as the printhead is scanned over a print surface 36, a clock pulse 42 (via timing link 44) and an actuating signal 38 (via link 37).

As is known e.g. from EP-A-O 277 703, incorporated herein by reference, appropriate application of voltages to the electrodes on either side of a channel wall will result in a potential difference being set up across the wall which in turn will cause the poled piezoelectric material of the channel walls to deform in shear mode and the wall to deflect transversely relative to the respective channel. One or both of the walls bounding an ink channel can be thus deflected: movement into the channel decreasing the channel volume, movement out of the channel increasing the channel volume. As is known from EP '703, such movement sets up pressure waves along the active length of the channel which cause a droplet of ink to be expelled from the nozzle. The active length of the construction shown in FIG. 2 is denoted by "L" and will be seen to be that length of the channel extending between the nozzle and the connection (window 27) to the source of droplet liquid fluid. This length is closed on all sides by the channel walls and cover respectively such that movement of the walls results in a change in pressure in droplet fluid.

It should be noted that in constructions of the type shown in FIGS. 1–3, it is usually convenient for connections to be made between the wall electrodes internally to provide one electrode per channel: when a voltage is applied to the electrode corresponding to a channel and a datum voltage is applied to the electrodes of the neighboring channels, the resulting potential differences across the two walls bounding the channel then effect displacements of each wall. Regardless of whether the connections between wall electrodes are made internally or externally of the printhead, it is then convenient to describe the voltage as being applied "to a selected channel." It is such a voltage that is applied as the actuating signal 38 to the drive circuit 32 and that is subsequently applied to the connection track 14 for each channel in accordance with the print data 35 applied via link 34.

As mentioned above, the present invention results from the discovery that for a given printhead of the kind described above, there is a length of period at which the actuating signal can be held at a given non-zero level which is greater than that length of period at which the velocity of droplets ejected from said channel is at its maximum and at which the sensitivity to pattern dependent crosstalk of a channel of the array is significantly reduced to the point of being avoided altogether.

Figures 4A, 4B:
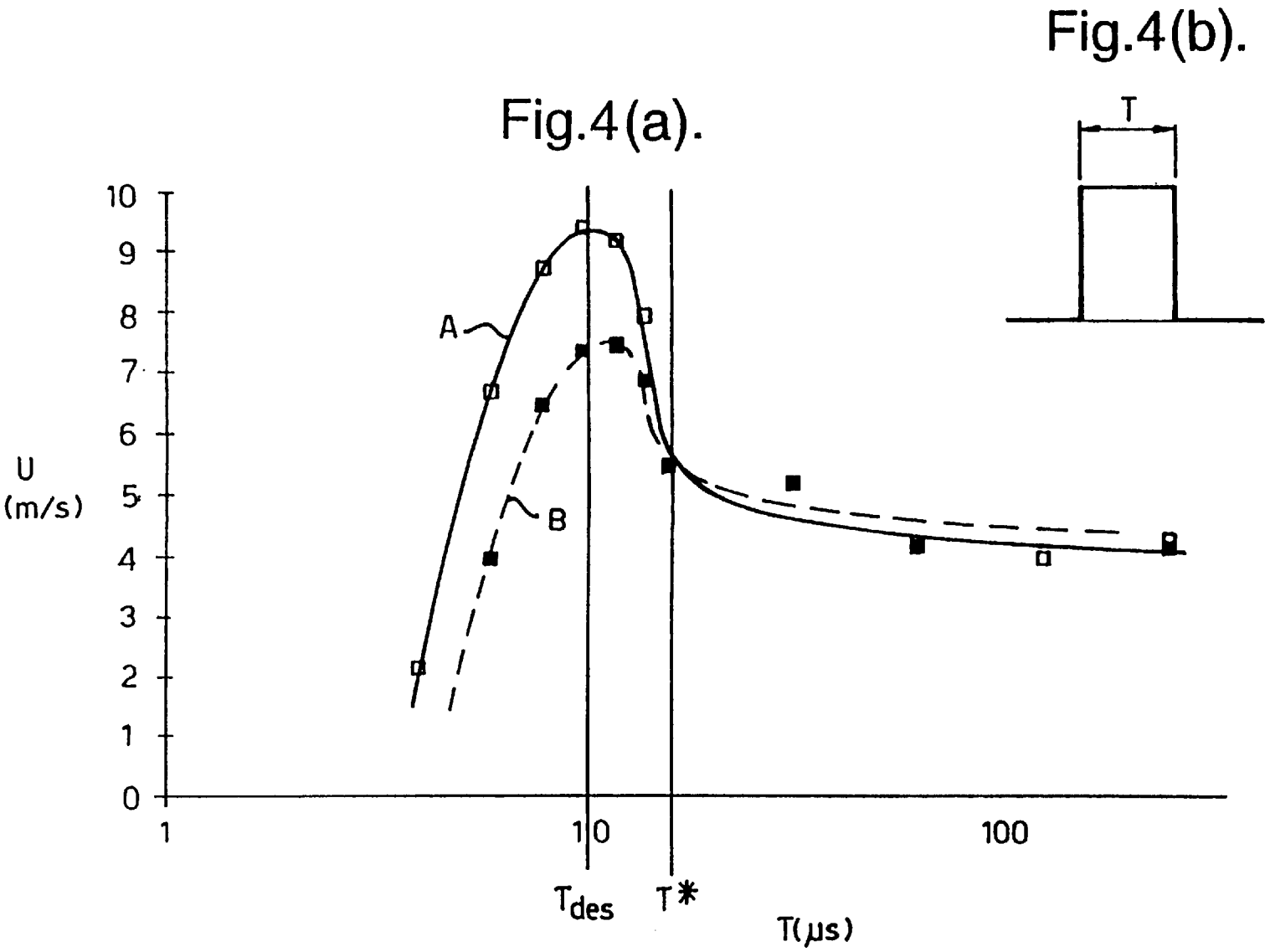
FIG. 4(*a*) is a graph illustrating the discovery upon which the present invention is based, with the velocity U of a drop ejected from a channel being shown as the ordinate and the period for which the actuating signal is held at a given non-zero level being shown as the abscissa.

This is illustrated in FIG. 4(*a*), which shows the variation in the velocity of a droplet ejected from a channel with the length T of a square wave actuating signal (shown in FIG. 4(*b*)) applied to a channel of an array for two different printing patterns A and B. In printing pattern A (denoted by a solid line), every third channel of the array of channels in a printhead is fired simultaneously using the actuating signal of FIG. 4(*b*), resulting in a repeating printing pattern of "+−+−+−", wherein + and − indicate the ejection/non-ejection of a droplet from a channel respectively. In printing pattern B, a single channel of the printhead is fired, again using the actuating signal of FIG. 4(*b*).

It can be seen that for the majority of values of T, the velocity of droplets ejected from a channel when fired as part of the printing pattern A is different to the droplet velocity obtained when that channel is fired alone as per printing pattern B. However, FIG. 4(*a*) also shows that there does exist a value of T—denoted T*—at which there is no substantial-difference in ejection velocity from a filing channel when that channel becomes involved in printing a different pattern (i.e. pattern A instead of pattern B or vice versa).

It can further be seen that the value of T* is greater than the design point Tdes of the printhead channels. Tdes is the time taken for a pressure wave in the fluid to travel the active length of a channel i.e. half the period of oscillation of pressure waves in the channel. It is approximately equal to Lc, L and c being the active length of the channel and the effective velocity of pressure waves in the fluid respectively, although nozzle characteristics also have a determining role. Tdes may also be found by experiment: it is at values of T around Tdes that maximum droplet ejection velocity is obtained, although, as evidenced in FIG. 4(*a*), the value obtained in this manner may be influenced by the printing pattern. In the particular printhead arrangement used to obtain FIG. 4(*a*), Tdes is 12 $\mu$s while T* is approximately 20 $\mu$s, giving a ratio T*/Tdes of approximately 1.7.

That T* should be greater than Tdes is in complete contrast to the known art (e.g. WO 95/25011) which teaches that printing pattern crosstalk can only be minimised but not eliminated (as evident from FIG. 4(*a*)) by holding the actuating signal for a period of length less than Tdes.

Techniques for measuring the velocity of droplets ejected from a channel of a printhead are known in the art one method entails ejecting ink droplets onto paper and measuring the accuracy of drop landing. In another, preferred, method, droplet ejection from channel nozzles is observed stroboscopically under a microscope: a difference between droplets (which have been ejected simultaneously) in the distance from the nozzle plate when viewed in this fashion is indicative of a difference in ejection velocity, whist droplet velocity can be gauged from the distance itself.

Figures 5A, 5B:
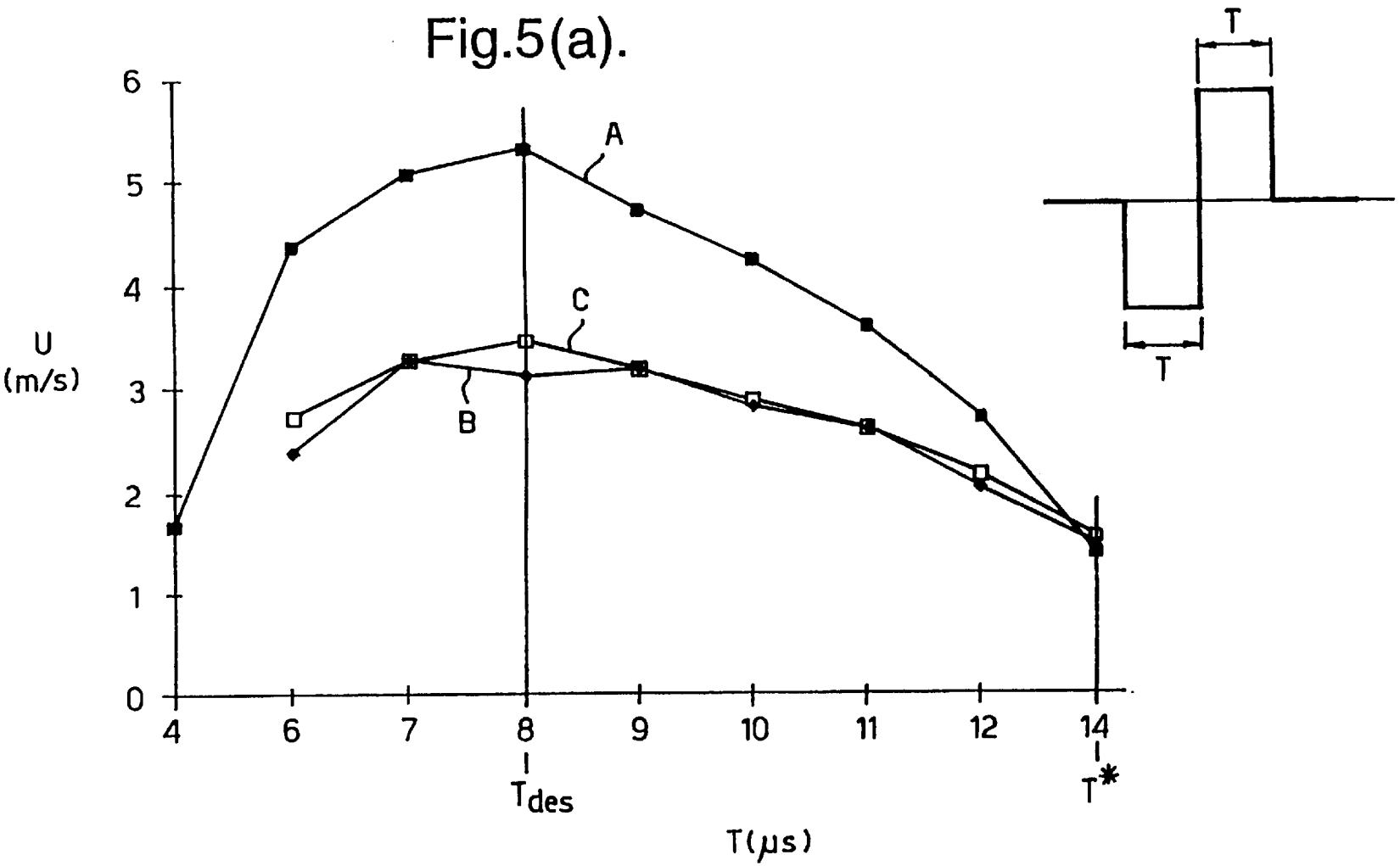
FIG. 5(*a*) is a further graph illustrating the present invention, with FIG. 5(*b*) showing the form of the actuating signal used to obtain such results.

FIG. 5(*a*) demonstrates that the relationship T*>Tdes holds true for other, more complex actuating signals as shown in FIG. 5(*b*) and which comprise not only a period in which the channel is held in a given expanded state but also a period in which the channel is held in a given contracted state, thereby to eject an ink drop. The figure also confirms that the is invention applies not only to the one-in three and single channel printing patterns (patterns A and B) employed in FIG. 4 but also to printing patterns where only every sixth channel is fired (pattern C). Curves A–C in FIG. 5(*a*) converge on a value of T* equal to 1.75 Tdes, which is substantially the same as the value shown in FIG. 4.

Figure 6:
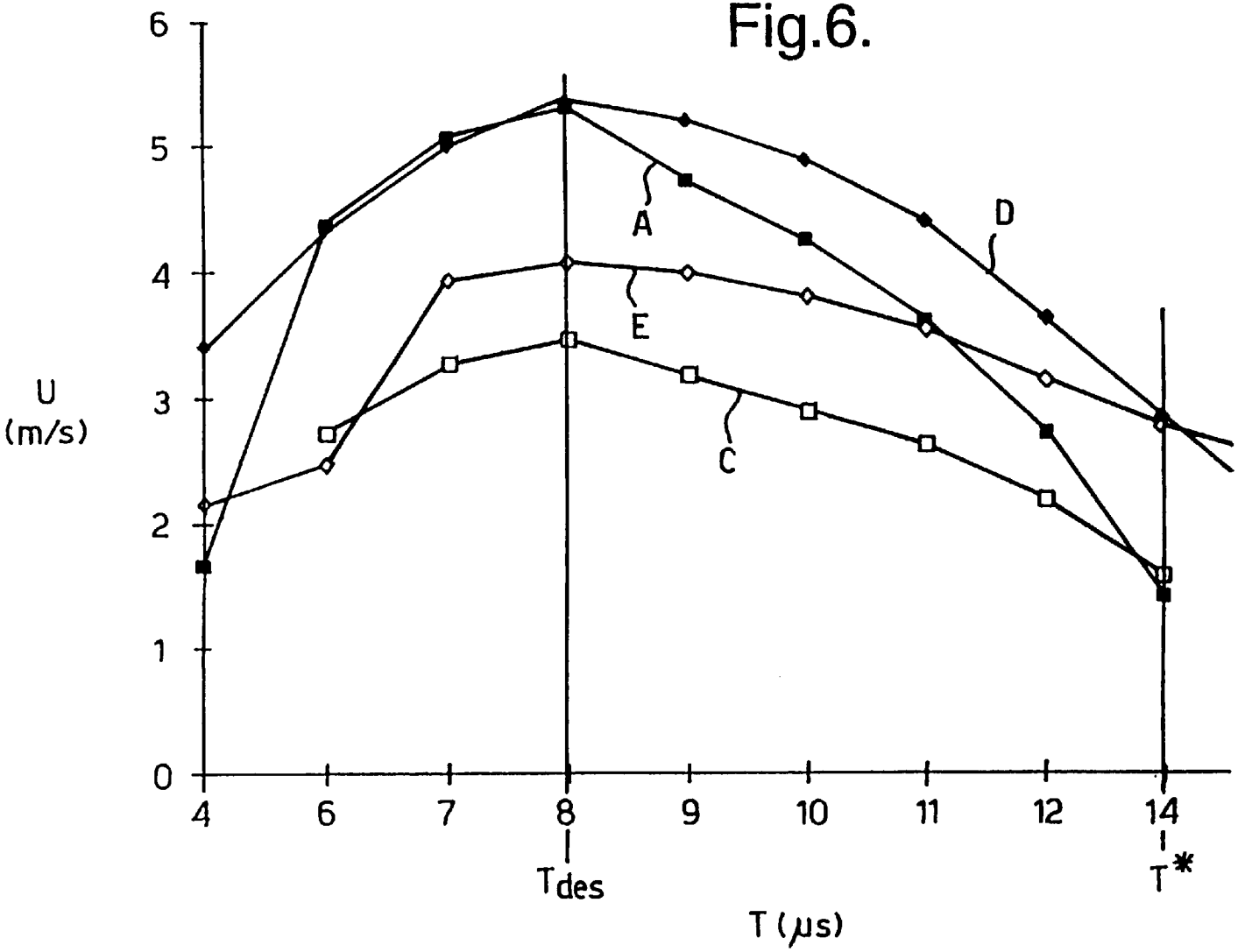
FIG. 6 is a graph illustrating the present invention with Inks of differing viscosity.

FIG. 6 depicts the results of FIG. 5(*a*) together with results obtained using the same design of printhead using a lower viscosity ink. Since a lower viscosity ink requires less energy to eject a droplet at a given velocity, the magnitude of the actuation signal used to obtain the after results was reduced (by 16%) so as to normalise the peak velocities of the two sets of results. Unes A and C of FIG. 6 correspond to lines A and C of FIG. 5, while lines D and E correspond to one in three and one in six channels firing at a lower viscosity respectively. From the figure it will be seen that, for a given peak ejection velocity, the value of T at which there is no pattern dependent crosstalk is independent of fluid viscosity.

Figure 7B:
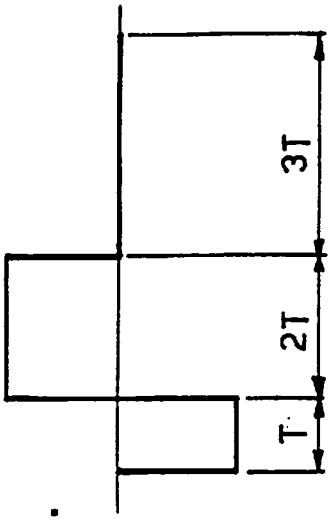
FIGS. 7 and 8 illustrate the present invention in printheads having a different active length to those used to obtain the characteristics shown in FIGS. 4–6.
Figure 7A:
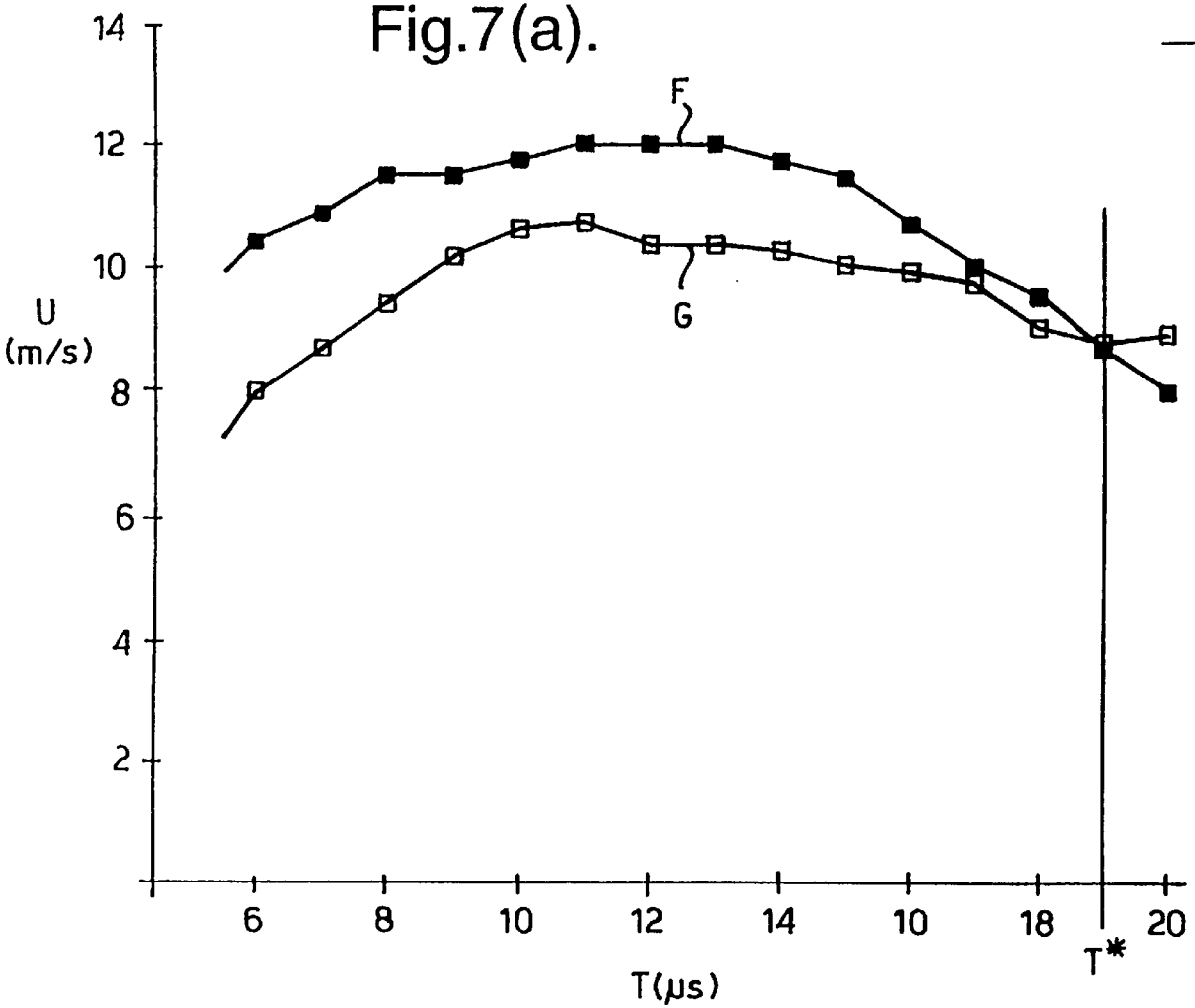
Figures 8A, 8B:
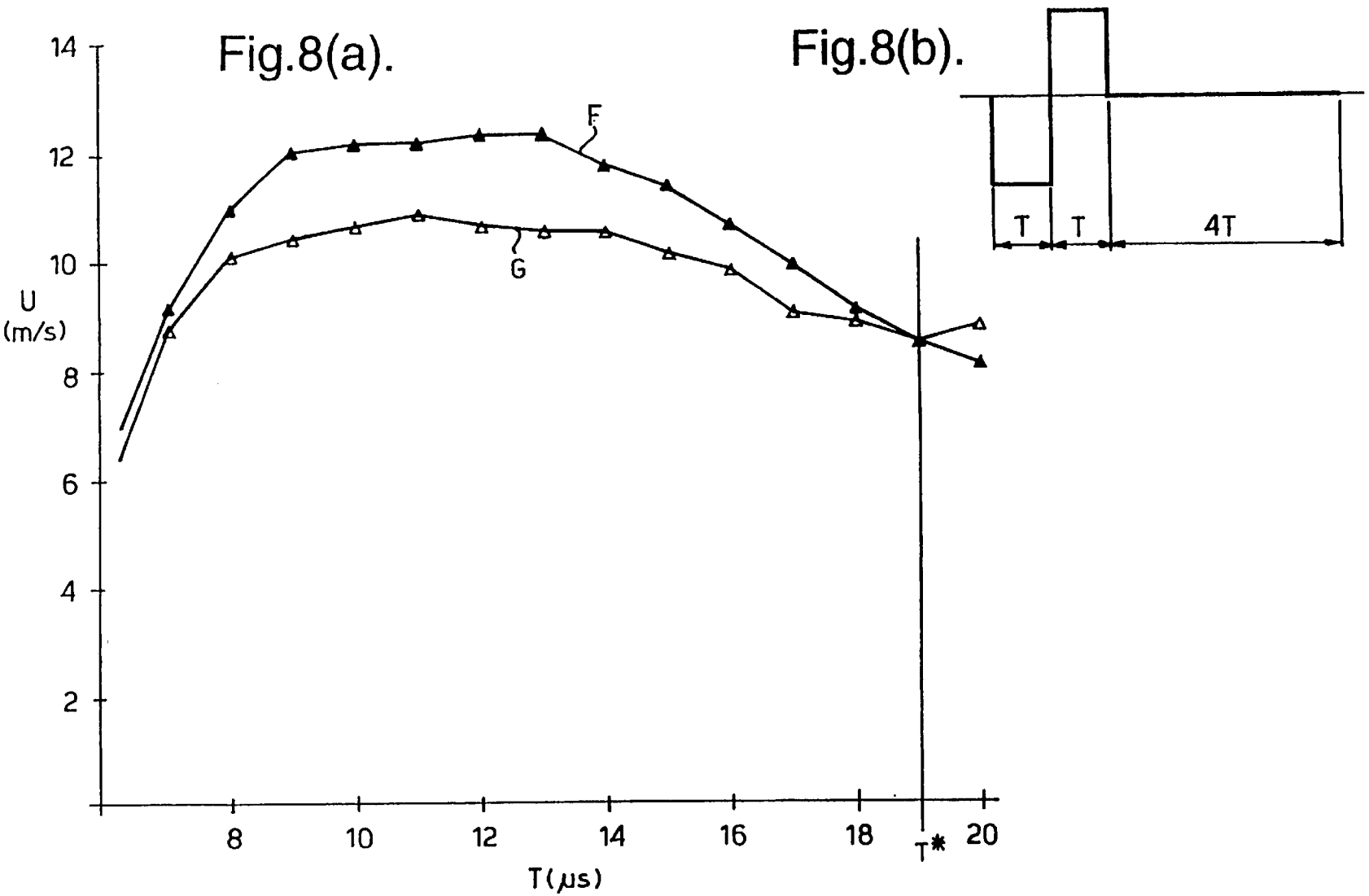

The results shown in FIGS. 4–6 are for printheads having an active channel length of 4 mm and an operating voltage of the order of 20V. Preferably the channel and wall widths are of the order of 70 $\mu$m and the channel depth lies in the range 250 $\mu$m–400 $\mu$m. FIGS. 7 and 8 show similar results obtained using a printhead having similar channel width and depth dimensions but a greater active channel length of 6 mm. One-in-three and one-in-six channel operation correspond to curves F and G respectively; FIGS. 7(*b*) and 8(*b*) illustrate the different actuating signals used in obtaining the curves. As with FIGS. 4–6, the length of the channel expansion signal period at which pattern crosstalk free operation occurs is independent of the actuating signal and, at 19 $\mu$s, corresponds again to approximately 1.7 times the length of period (Tdes) at which maximum droplet ejection velocity is obtained.

The present invention is particularly—although not exclusively—applicable to a printhead where the channels are divided into two, three or more groups for operation. Operation with successive channels alternately assigned to two groups is known in the art e.g. from EP-A-O 278 590. Operation with channels divided into three or more groups actuated in rotation is also known in the art e.g. from EP-A-O 376 532. In all cases of group operation, the incoming print data will often be such that successive channels belonging to the same group will be fired simultaneously. Similarly, it will often happen that two channels belonging to the same group and firing simultaneously will be separated by a channel also belonging to the same group and yet not filing. These two situations are illustrated schematically in FIGS. 9(*a*) and 9(*b*) respectively. The present invention seeks to avoid any difference in ejection velocity between these two firing patterns by applying an actuating signal to those channels of a group that are to be fired, the, signal being held at a given non-zero level for a period, wherein the length of the period is chosen such that it is greater than Tdes and such that the velocity of a droplet ejected from a selected channel belonging to a first group is substantially independent of whether or not other channels also belonging to the first group and located in the array directly adjacent said selected channel have said actuating signal applied to effect droplet ejection simultaneously with droplet ejection from the selected channel.

Such a period length can be determined experimentally, with drop velocity from one or more channels being advantageously measured using stroboscopic methods as described above. FIGS. 9(*a*) and (*b*) illustrate the—undesirable—case where there is a change in velocity with printing pattern and a corresponding change in the distance between the nozzle plate and drops ejected from nozzles in the nozzle plate and viewed stroboscopically: droplets are ejected at a higher velocity when every one in three channels of the printhead is operating (FIG. 9(*a*)) resulting in a greater distance (×1) being travelled by a droplet in a given time interval than that (×2) travelled when only one in six channels is operating (FIG. 9(*b*)). It will be understood that the firing patterns shown in FIGS. 9(*a*) and (*b*) correspond to the one-in-three and one-in-six firing patterns used to obtain the curves A and C in FIG. 5(*a*): the value of T* shown in FIG. 5 would therefore also be applicable for three-cycle operation.

Operation in groups according to the present invention is not restricted as regards the manner in which the channel volume can be varied. However, when using an actuating waveform of the kind shown by way of example in FIG. 5(*b*), it has been found that the respective lengths of the expansion and contraction periods may advantageously be chosen such that there is generated no pressure wave contribution to the droplet liquid in those channels belonging to the next group of channels to be enabled for actuation. Such a pressure wave contribution might otherwise affect the velocity of the droplets ejected from some or all of the channels of the next group, causing it to deviate from the value of velocity of the droplets ejected from the earlier group.

The respective lengths of the channel contraction signal period and the channel expansion signal period can be determined by a process of trial and error starting from a waveform of the type discussed above having expansion and contraction periods of equal length and giving crosstalk-free operation for channels belonging to the same group, the duration of either of these periods, but in particular the duration of the channel contraction signal period is varied until no significant variation in the velocity between droplets ejected from groups of channels can be measured. The end of the channel contraction signal period—at which the channel walls move out to their undisplaced position—is advantageously timed so as to generate in each of the channels sharing a side wall with the actuated channel a pressure pulse which cancels out any pressure waves remaining in these channels. Such pressure waves will have been generated by the movement of the channel walls at earlier points in the actuating signal.

Alternatively, having empirically determined the timing of the final edge of the channel expansion signal necessary to avoid pattern-dependent cross talk, it is possible to calculate the necessary timing of the final edge of the channel compression signal: while not wishing to be bound by this theory, it is believed that for a simple waveform of the kind shown in FIG. 10, the condition whereby no pressure waves remain in a channel can be expressed as $$P(t\mathbf{1}).e^{-e(t3-t1)}.\cos\Omega(t\mathbf{3}-t\mathbf{1})+P(t\mathbf{2}).e^{-e(t3-t2)}.\cos\Omega(t\mathbf{3}-t\mathbf{2})+P(t\mathbf{3})=0$$

where P(t1), P(T), P(t3) are the pressure pulses generated at time t1, t2, t3 by the corresponding steps in the actuating signal and c and Ω are the decay constant and natural frequency of pressure waves in the channel respectively. Where—as shown in FIG. 10—the magnitude of the expansion and compression components of the actuation signal are equal, the step changes in the actuating signal and the corresponding pressure pulses can be normalised to 1,−2 and 1 and the above equation reduced to $$e^{-e(t3-t1)}.\cos t\Omega(t\mathbf{3}-t\mathbf{1})-2.e^{-e(t3-t2)}.\cos\Omega(t\mathbf{3}-t\mathbf{2})+1=0$$

Values of c and Ω for a printhead can be determined by fitting a linear harmonic equation of the form A−B. cos(ΩT). $e^{-eT}$ (ΩT).$e^{-eT}$ to the U-T characteristic of the kind shown in FIG. 4 (the values determined will vary slightly depending on whether the equation is shifted to the "single channel firing" or "one-in-three channels firing" characteristic) while t1 and t2 will be determined by the duration of channel expansion signal required to give pattern-crosstalk-free operation. It is therefore possible to solve the above equation to obtain a value for t3: it has been found that such calculated values agree with experimentally determined values to within 10%.

Following the final edge of the compression signal, the same waveform may be applied immediately to channels belonging to the next group to be enabled. Alternatively, as shown in FIG. 10, a rest period may be incorporated into the waveform prior to application of the waveform to the next group of channels at time t4. It has been found advantageous to make the length of the rest period (t4−t3) greater than L/c so as to allow complete pressure wave cancellation to take place. In addition, the length of the rest period may be chosen such that the resulting frequency of droplet ejection is of a value compatible with the rate of supply of print data. Alternatively, given a desired droplet ejection frequency, the characteristics of the printhead (in particular the active length) and the duration of the rest period may be adjusted to match this frequency.

By way of example, in a printhead of the kind shown in FIGS. 1–3 and having a Tdes value of 12 μs, crosstalk-free operation of a printhead having channels arranged into three interleaved groups was obtained using a single level waveform (having expansion and compression signals of equal magnitude) having (t2−t1)=1.55 Tdes, (t3−t2)=1.8 Tdes and (t4−t3)=1.65 Tdes, the waveform having a total duration of 5 Tdes, (although a total duration equal to an integer multiple of L/c need not be the case) corresponding to a droplet ejection frequency of 1/(3×5×12E-6)=5.6 kHz.

It will be appreciated that all the pressure pulse sequences of the present invention are amenable, where appropriate, to implementation by means of unipolar voltages applied to firing and adjacent, non-firing channels. Such actuation is described in WO 95/25011, incorporated herein by reference.

The present invention is applicable to printheads operating in both binary (single drop size) and multipulse (also known as "multi-drop" or "greyscale") mode where channels in a group may be actuated several times in a single cycle. Examples of the latter are known in the art and disclosed, for example, in EP-A-O 422 870. It will further be appreciated that the present invention is not intended to be restricted to the type of printhead described by way of example above. Rather, it is considered to be applicable to any type of droplet deposition apparatus comprising an array of parallel channels separated one from the next by side walls extending in the lengthwise direction of the channels, optionally supplied from a common manifold, and channel walls displaceable relative to the channel in response to an actuating signal. Such constructions are known, for example, from U.S. Pat. Nos. 5,235,352, 4,584,590 and 4,825,227.

I claim:

1. A method of operating a multi-channel pulsed droplet deposition apparatus having an array of parallel channels, disposed side by side and separated one from the next by side walls extending in the lengthwise direction of the channels;

a series of nozzles which communicate respectively with said channels for ejection of droplets therefrom;

connection means for connecting the channels with a source of droplet fluid;

and electrically actuable means for displacing a portion of a side wall in response to an actuating signal, thereby to eject a droplet from said selected channel, the method comprising the steps of applying an actuating signal to said electrically actuable means to eject a droplet from a selected channel, the signal being held at a given non-zero level for a period, the length of said period being such that:

(a) it is greater than the length of that period which would result in the velocity of droplets ejected from said channel being at its maximum; and (b) the velocity of a droplet ejected from said selected channel is substantially independent of whether or not channels in the vicinity of said selected channels are similarly actuated to effect droplet ejection simultaneously with droplet ejection from selected channel.

2. Method according to claim 1 wherein said selected channel is held in a contracted state for said period.

3. Method according to claim 2 wherein said channel is a non-actuated state directly prior to and directly following said period.

4. Method according to claim 2 wherein said period during which said channel is held in a contracted state is directly preceded by a further period during which said channel is held in a expanded state.

5. Method according to claim 4 wherein said period and said further period having the same duration.

6. Method according to claim 1 wherein channels share a common droplet fluid supply manifold.

7. Method as claimed in claim 1 wherein the velocity of said droplet ejected from said selected channel is greater than 1 m/s.

8. A method according to claim 1 wherein successive channels of the array are regularly assigned to groups such that a channel belonging to any one group is bounded on either side by channels belonging to at least one other group;

the length of said period being such that:

(a) it is greater than the length of that period which would result in the velocity of droplets ejected from said channel being at its maximum; and (b) the velocity of a droplet ejected from said selected channel is substantially independent of whether or not those channels belonging to the same group as the selected channel and which are located closest to said selected channel in the array are similarly actuated to effect droplet ejection simultaneously with droplet ejection from the selected channel.

9. Method according to claim 8 wherein the ratio of the duration of said second period to said period is chosen such that there is generated no pressure wave contribution affecting the velocity of droplet ejection from those channels belonging to the next group of channels to be enabled.

10. Method according to claim 9 wherein the ratio of said period to said second period is approximately 3:4.

11. Method according to claim 10 wherein successive channels of the array are in turn assigned to each of three groups.

12. Method according to claim 1 or claim 8 wherein the length of the period at which the velocity of droplets ejected from said channel is at its maximum is substantially equal to L/c, where c is the effective velocity of pressure waves in the fluid in said channel and L is the length of channel extending between the nozzle and the connection means connecting the channel with a source of droplet fluid.

13. Method according to claim 12 wherein said selected channel is held in an expanded state for said period.

14. Method according to claim 13 wherein said selected channel is in a non-actuated state directly prior to and following said period.

15. Method according to claim 13 wherein the volume of said selected channel is held at a given expanded volume for said period and directly thereafter at a given contracted volume for a second period.

16. Method according to claim 15 wherein said second period is longer than said period.

17. Method according to claim 15 wherein the ratio of the duration of said second period to said period is chosen such that there is generated no pressure wave contribution affecting the velocity of droplet ejection from the channels belonging to the next group of channels to be enabled.

18. Method according to claim 17 wherein the ratio of said period to said second period is approximately 3:4.

19. Method according to claim 18 wherein successive channels of the array are in turn assigned to each of three groups.

20. Method according to claim 12 wherein said period is greater than that length of the period at which the velocity of droplets ejected from said channel is at its maximum by a factor of approximately 1.7.

21. Method of selecting a signal for actuating electrically actuable means for displacing a portion of a side wall extending along a channel of a multi-channel pulsed droplet deposition apparatus, thereby to effect droplet ejection therefrom, said apparatus having an array of parallel channels, disposed side by side and separated one from the next by side walls extending in the lengthwise direction of the channels, a series of nozzles which communicate respectively with said channels for ejection of droplets therefrom and connection means for connecting the channels with a source of droplet fluid, said signal being held at a non-zero level for a period, the method comprising the steps of:

(a) applying said signal to a selected channel of said array and measuring the velocity of the droplet ejected from the selected channel;

(b) applying said signal to said selected channel and simultaneously to channels in the vicinity of said selected channel and measuring the velocity of the droplet ejected from the selected channel; and (c) choosing the length of period such that there is substantially no variation in velocity between droplets ejected from the selected channel under regime (a) and droplets ejected from the selected channel under regime (b).

22. A multi-channel pulsed droplet deposition apparatus having an array of parallel channels, disposed side by side and separated one from the next by side walls extending in the lengthwise direction of the channels:

a series of nozzles which communicate respectively with said channels for ejection of droplets therefrom;

connection means for connecting the channels with a source of droplet fluid;

and electrically actuable means for displacing a portion of a side wall in response to an actuating signal, thereby to eject a droplet from said selected channel, and a drive circuit for applying an actuating signal to said electrically actuable means to eject a droplet from a selected channel, the drive circuit being arranged to hold the signal at a given non-zero level for a period, the length of said period being such that:

(a) it is greater than the length of that period which result in the velocity of droplets ejected from said channel being at its maximum; and (b) the velocity of a droplet ejected from said selected channel is substantially independent of whether or not channels in the vicinity of said selected channel are similarly actuated to effect droplet ejection simultaneously with droplet ejection from said selected channel.

23. Apparatus according to claim 22 wherein said selected channel is held in a contracted state for said period.

24. Apparatus according to claim 23 wherein said channel is in a non-actuated stated directly prior to and directly following said period.

25. Apparatus according to claim 23 wherein said period during which said channel is held in a contracted state is directly preceded by a further period which said channel is held in a expanded state.

26. Apparatus according to claim 25 wherein said period and said further period have the same duration.

27. Apparatus according to claim 22 wherein channels share a common droplet fluid supply manifold.

28. Apparatus as claimed in claim 22 wherein the velocity of said droplet ejected from said selected channel is greater than 1 m/s.

29. Apparatus according to claim 22 wherein successive channels of the array are regularly assigned to groups such that a channel belonging to any one group is bounded on either side by channels belonging to at least one other group;

the length of said period being such that:

(a) it is greater than the length of that period which would result in the velocity of droplets ejected from said channel being at its maximum; and (b) the velocity of a droplet ejected from said selected channel is substantially independent of whether or not those channels belonging to the same group as the selected channel and which are located closest to said selected channel in the array are similarly actuated to effect droplet ejection simultaneously with droplet ejection from the selected channel.

30. Apparatus according to claim 29 wherein the ratio of the duration of said second period to said period is chosen such that there is generated no pressure wave contribution affecting the velocity of droplet ejection from those channels belonging to the next group of channels to be enabled.

31. Apparatus according to claim 30 wherein the ratio of said period to said second period is approximately 3:4.

32. Apparatus according to claim 31 wherein successive channels of the array are in turn assigned to each of three groups.

33. Apparatus according to claim 22 or claim 29 wherein the length of the period at which the velocity of droplets ejected from said channel is at its maximum is substantially equal to L/c, where c is the effective velocity of pressure waves in the fluid in said channel and L is the length of channel extending between the nozzle and the connection means connecting the channel with a source of droplet fluid.

34. Apparatus according to claim 33 wherein said selected channel is held in an expanded state for said period.

35. Apparatus according to claim 34 wherein said selected channel is in a non-actuated state directly prior to and following said period.

36. Apparatus according to claim 34 wherein the volume of said selected channel is held at a given expanded volume for said period and directly thereafter at a given contracted volume for a second period.

37. Apparatus according to claim 36 duration of said second period to said period is chosen such that there is generated no pressure wave contribution affecting the velocity of droplet ejection from those channels belonging to the next group of channels to be enabled.

38. Apparatus according to claim 37 wherein the ratio of said period to said second period is approximately 3:4.

39. Apparatus according to claim 38 wherein successive channels of the array are in turn assigned to each of three groups.

40. Apparatus according to claim 36 wherein said second period is longer than said period.

41. Apparatus according to claim 33 wherein said length of said period is greater than that length of the period at which the velocity of droplets ejected from said channel is at its maximum by a factor of approximately 1.7.

* * * * *